US005133115A

United States Patent [19]

Bock

[11] Patent Number: 5,133,115

[45] Date of Patent: Jul. 28, 1992

[54] SAFETY BELT BUCKLE WITH ANTI-SHOCK DEVICE

[75] Inventor: Andreas Bock, Notorf, Fed. Rep. of Germany

[73] Assignee: Autoflug GmbH & Co. Fahrzeugtechnik, Rellingen, Fed. Rep. of Germany

[21] Appl. No.: 768,236

[22] PCT Filed: Feb. 15, 1990

[86] PCT No.: PCT/DE91/00075

§ 371 Date: Oct. 10, 1991

§ 102(e) Date: Oct. 10, 1991

[87] PCT Pub. No.: WO91/11932

PCT Pub. Date: Aug. 22, 1991

[30] Foreign Application Priority Data

Feb. 15, 1990 [DE] Fed. Rep. of Germany ..... 4004701

[51] Int. Cl.[5] ..... A44B 11/25

[52] U.S. Cl. ..... 24/633; 24/639; 24/642

[58] Field of Search ..... 24/633, 634, 636, 639, 24/640, 641, 642, 650, 651, 652

[56] References Cited

U.S. PATENT DOCUMENTS 4,339,854 7/1982 Ikesue ..... 24/639
4,622,727 11/1986 Wier ..... 24/641
4,870,826 10/1989 Eksell et al. ..... 24/641

FOREIGN PATENT DOCUMENTS 2807575 8/1979 Fed. Rep. of Germany ..... 24/641
3535056 2/1987 Fed. Rep. of Germany ..... 24/633

*Primary Examiner*—Victor N. Sakran
*Attorney, Agent, or Firm*—Robert W. Becker & Associates

[57] ABSTRACT

A safety belt buckle with an anti-shock device is provided. The safety belt buckle comprises a housing that has an insertion slot for an insertion tongue with a cutout. A spring-loaded ejector for the insertion tongue is provided in the insertion slot. A latch is supported within the housing and cooperates with the cutout of the insertion tongue in a locking position of said safety belt buckle. The latch fastens the insertion tongue by engaging a respective recess provided at the housing. A sliding key which is loaded by a spring and is slidable in a direction that is transverse to a plane of movement of the latch is provided for releasing the latch from the locking position. A securing element that is slidably disposed within the housing for fixing and securing the latch in the locking position of the safety belt buckle is provided, whereby the securing element, for releasing the locking position of the safety belt buckle, is slidable by the sliding key into a release position of the latch. A compensating mass is positioned between the sliding key and the securing element whereby the compensating mass is supported at a further spring that loads the securing element in a securing position thereof.

8 Claims, 3 Drawing Sheets

20
24
21
23
25
32
33
17
22
28
26
27

34

30

29
31

SAFETY BELT BUCKLE WITH ANTI-SHOCK DEVICE

BACKGROUND OF THE INVENTION

The present invention relates to a safety belt buckle for receiving and locking an insertion tongue; the safety belt buckle has a housing with an insertion slot for the insertion tongue with a spring-loaded ejector arranged in the insertion slot, a latch that is arranged within the safety belt buckle and cooperates with a cutout of the insertion tongue in a locking position, with the latch holding the insertion tongue in a coordinated recess of the safety belt buckle, and a spring-loaded sliding key that is guided transverse to a plane of movement of the latch for cancelling the locking position, whereby a securing element is movably arranged within the housing which, in the locking position of the safety belt buckle, fixes and secures the latch and is movable by the sliding key into a releasing position of the latch for releasing the safety belt buckle.

A safety belt buckle of the aforementioned kind is described in DE-OS 27 19 325. In this known safety belt buckle, the latch, which is disposed in the safety belt buckle housing and has a tendency to open by itself is secured by a securing element which is arranged in the plane of the sliding key and is movable in the same direction as the sliding key so that the latch is secured in a position in which it locks the insertion tongue. When releasing the safety belt buckle the sliding key with coordinated abutments first moves the securing element into a releasing position for the latch so that the latch opens and releases the insertion tongue while simultaneously releasing the safety belt buckle.

The safety belt buckle of the aforementioned kind ha the disadvantage that the safety belt buckle is not protected against shock-type acceleration forces occurring especially in the plane of the sliding key movement, such forces, for example, occurring when the safety belt buckle is moved in its longitudinal direction in the course of a tightening step of the safety belt during an accident. When during the course of such a tightening movement the safety belt buckle at the end of the tightening movement is suddenly stopped, then the sliding key, due to its own mass inertia, continues the movement in the tightening direction so that the sliding key and the housing of the safety belt buckle perform a movement relative to one another with which the sliding key is inserted into the safety belt buckle and moves the securing element into the releasing position of the latch. Thus, with the aforementioned safety belt buckle, a self-opening of the safety belt buckle is possible in the course of a tightening movement acting on the safety belt buckle.

It is therefore an object of the invention to improve a safety belt buckle of the aforementioned kind such that it is shock-protected against acceleration forces in the actuating direction of the sliding key.

SUMMARY OF THE INVENTION

The solution to this object including advantageous embodiments and developments may be taken from the contents of the claims which are appended to this description.

The safety belt buckle of the present invention is primarily characterized by a housing having an insertion slot for an insertion tongue; a spring-loaded ejector for the insertion tongue provided in the insertion slot; a latch supported within the housing and cooperating with a cutout of the insertion tongue in a locking position of the safety belt buckle, the latch fastening the insertion tongue by engaging a respective recess provided at the housing; a sliding key, which is loaded by a spring and is slidable in a direction that is transverse to a plane of movement of the latch, for releasing the latch from the locking position; a securing element, that is slidably disposed within the housing, for fixing and securing the latch in the locking position of the safety belt buckle, the securing element, for releasing the locking position of the safety belt buckle, being slidable by the sliding key into a releasing position of the latch; and a compensating mass that is positioned between the sliding key and the securing element, the compensating mass being supported at a further spring that loads the securing element in a securing position thereof.

The invention in its basic concept provides that between the sliding key and the securing element a slidably arranged compensating mass is provided which is supported at a spring with which the securing element is loaded into its securing position.

An anti-shock device for a safety belt buckle in which the acceleration and mass forces that are acting onto the sliding key are already compensated by the arrangement of an additional compensating mass has been described in DE-OS 35 33 684. The construction of this safety belt buckle and the arrangement of the additional mass, however, are complicated and expensive and, furthermore, the compensating mass is acting essentially onto the sliding key itself.

The present invention has the advantage that with a simple construction of the safety belt buckle the securing element, which, during shock loads, is loaded by the sliding key but additionally simultaneously also subjected to acceleration and mass forces, is secured against its movement into a releasing position of the latch so that despite a tolerable insertion of the slide key to movement of the securing element into the releasing position of the latch takes place, but the securing element provides an additional compensation of the insertion movement of the sliding key in an impact situation.

In a preferred embodiment of the present invention the spring which is loading the securing element is provided in the form of a leaf spring that is connected to the ends of a rod-shaped securing element and which, with a portion facing the sliding key, is prestressed about an abutment means in the form of a projection that is fastened to the housing so that via the leaf spring the securing element is pulled, respectively, held in its securing position.

In order to generate this pre-stress and in order to cooperate with the compensating mass, the leaf spring is bent about a projection that is fastened to the housing and arranged at a side facing the sliding key whereby the compensating mass is supported at the leaf spring via a cross-piece that is engaging the leaf spring. It is advantageous that two spaced apart projections are provided arranged in a transverse direction of the safety belt buckle whereby the cross-piece of the compensating mass engages the leaf spring between the two projections.

In order to generate locking kinematics with an easy action, the connection between the leaf spring and the securing element is provided in the form of a slotted hole with which the ends of the leaf spring are slidable relative to the securing element.

In a preferred embodiment of the present invention the sliding key, the compensating mass and the securing element are arranged in the same plane of the safety belt buckle and parallel to an insertion plane of the insertion tongue. Herein, the respective supporting elements may be arranged in a simple manner relative to one another.

It is furthermore provided, that the individual aforementioned ends are arranged in different planes of the safety belt buckles relative to the insertion plane of the insertion tonque whereby then the supporting elements between the sliding key, the compensating mass and the securing element must be arranged at a slant relative to the longitudinal axis of the safety belt buckle.

According to an embodiment of the present invention it is provided that the spring of the sliding key is directly supported at the compensating mass whereby, especially during a normal actuation of the safety belt buckle, the compensating mass which is arranged between the spring of the sliding key and the spring which is loading the securing element no action of force occurs. Alternatively, it may be provided that for the support of the sliding key an abutment is provided at the housing which at the same time serves as a support for the compensating mass which is loaded by the spring that acts on the securing element. In this embodiment, occasionally occurring oscillations of the system, comprised of the sliding key, the compensating mass and the securing element, are avoided.

Additionally, the invention is not limited to safety belt buckles in which the latch has a tendency to open by itself. Since the invention is not primarily directed towards the locking mechanism of the safety belt buckle, the invention also extends to constructions in which the sliding key, after the sliding movement of the securing element into the releasing position of the latch, provides for an active pivoting of the latch.

BRIEF DESCRIPTION OF THE DRAWINGS

In the drawing embodiments of the present invention are represented which will be described in the following.

It is shown in.

DESCRIPTION OF PREFERRED EMBODIMENTS

Figure 1:
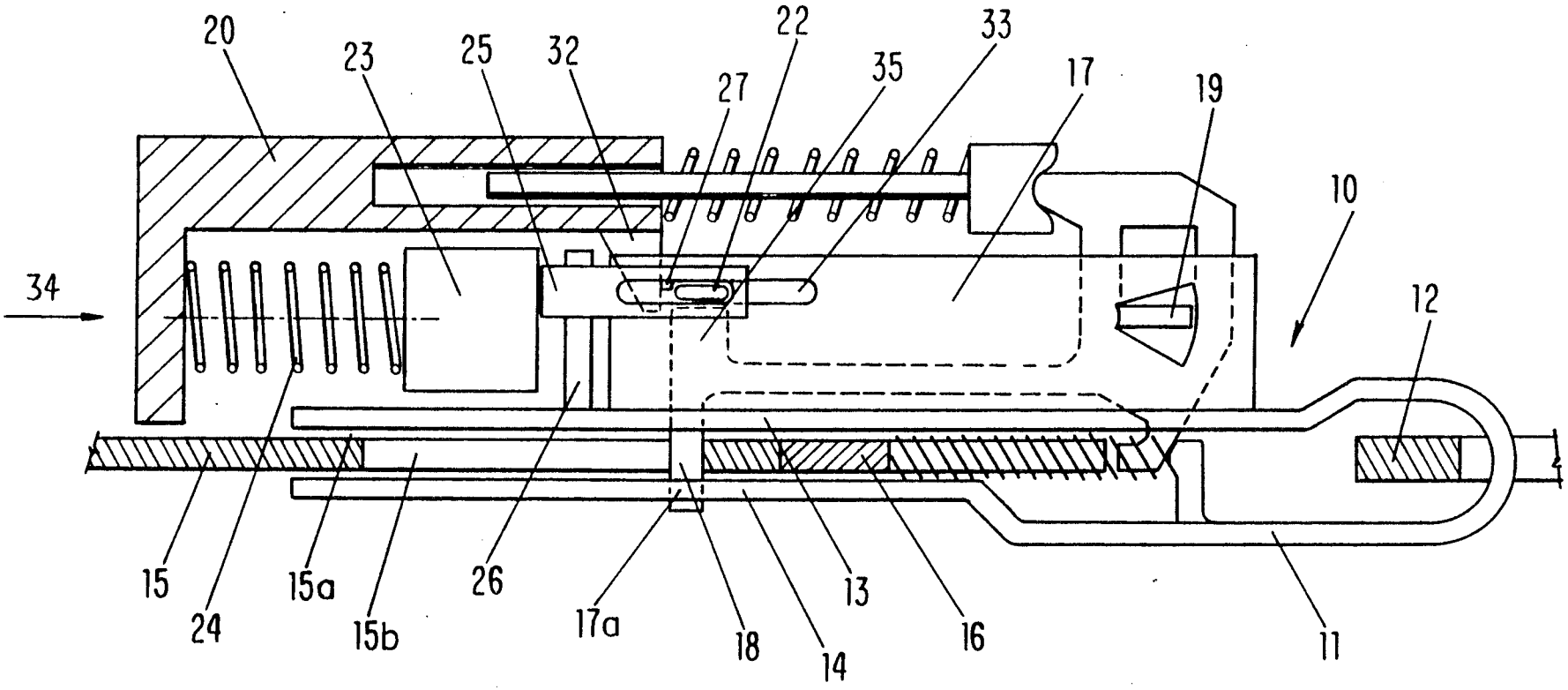
FIG. 1 a safety belt buckle in a partial cross-section.

A safety belt buckle 10 comprises a one-part buckle plate 11 which in the area of its fastening to an anchoring portion 12 is bent to form two legs 13, 14 of equal length between which an insertion slot 15*a* is formed and into which an insertion tongue 15 is insertable against the action of an ejector 16. The safety belt buckle has a housing with two side walls 17 which provide a U-shaped form to the safety belt buckle. To the rear of the two side walls 17 a latch 18 is supported perpendicularly to the insertion plane of the insertion tongue 15 in a pivotable manner at a joint 19. The latch 18 cooperates with a cutout 15*b* of the insertion tongue 15 in the locking position, whereby the latch 18 holds the insertion tongue 15 in a coordinated recess 17*a* of the housing. The latch 18 is secured by a securing element 22 which is slidable in the same direction as the sliding key 20 within the side walls 17 of the safety belt buckle 10. In its securing position which is oriented towards the sliding key 20 the securing element 22 is positioned on a projection 35 of the latch 18 and secures it against opening. When a releasing movement takes place the sliding key 20 with the coordinated abutments 32 acts on the securing element 22 which is for example guided in slotted holes 33 in the side walls 17 and moves it into a releasing position of the latch 18. The constructive embodiment of the details of this locking mechanism however is not the object of the present invention.

Figures 2A, 2B, 2C, 3A, 3B:
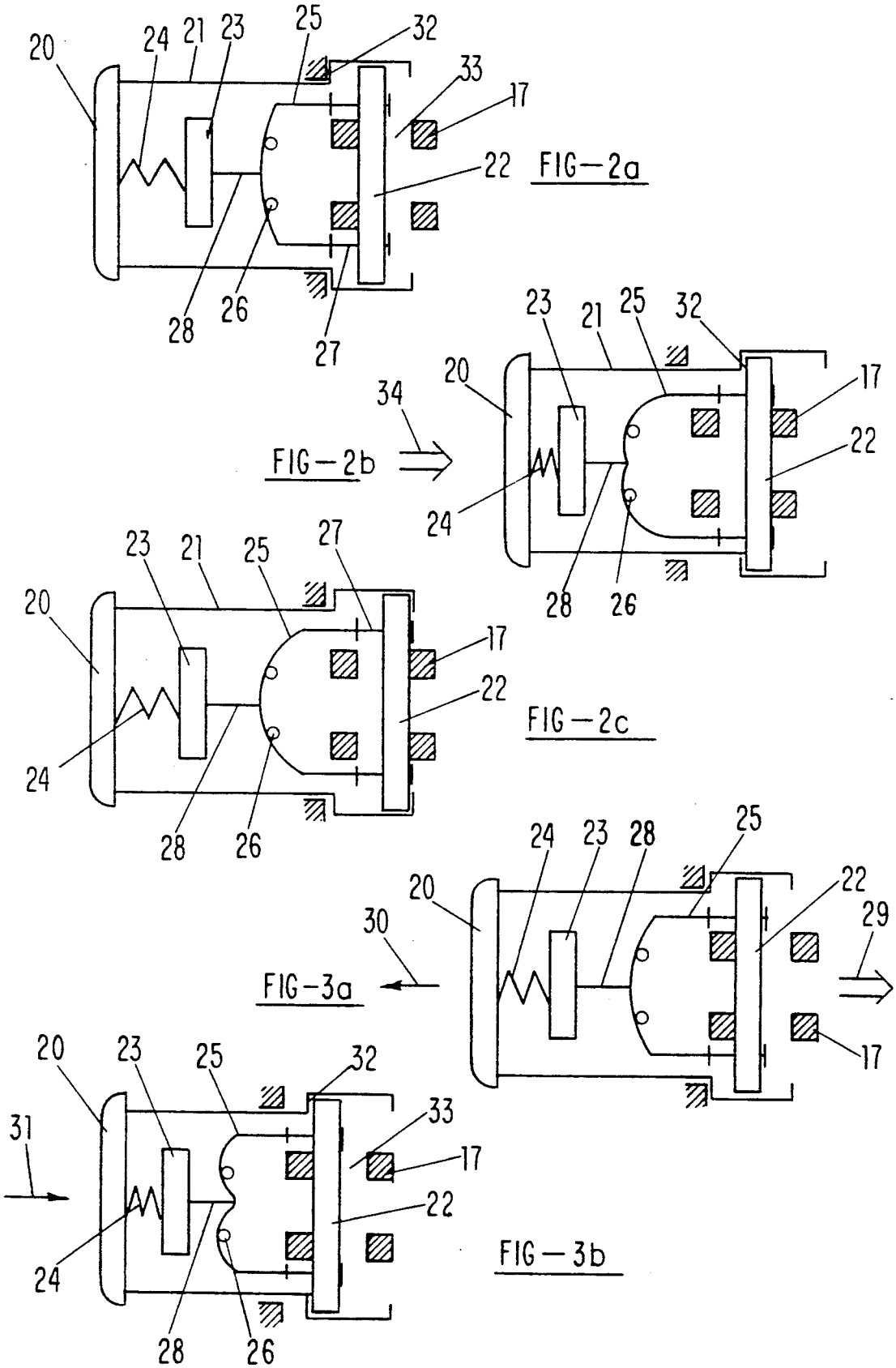
FIG. 2*a–c* a schematic representation of the positions of the safety belt buckle after movements without any acceleration forces, FIG. 3*a, b* a representation of the safety belt buckle corresponding to FIGS. 2*a–c* when acceleration forces occur, FIG. 4*a–c* another embodiment of the safety belt buckle corresponding to the representation in FIGS. 2*a–c*.

As can be seen clearly from the FIGS. 2*a–c*, the sliding key 20 is essentially U-shaped whereby at the two outer ends of its legs 21 the abutments 32 for moving the securing element 22 are arranged. Simultaneously, the sliding key 20 is thus fastened in its ejection direction at the side walls 17 so that the ejection direction of the sliding key 20 is thereby limited.

Between the legs 21 of the sliding key 20 the compensating mass 23 is supported in a slidable manner whereby the sliding key spring 24 which is arranged between the sliding key 20 and the compensating mass 23 is supported at the compensating mass. At the face of the compensating mass 23 which is facing away from the sliding key 20 a leaf spring 25 is bent about two spaced-apart projection 26 which are arranged in a transverse direction of the safety belt buckle and are fixedly connected to the housing, with ends of the leaf spring 25 being connected to the securing element 22 so that a pre-stress of the leaf spring 25 with a loading of the securing element 22 into its front securing position for the latch 18 results. The connection between the ends of the leaf spring 25 and the rod-shaped securing element 22 is achieved by providing slotted holes 27 in the legs of the leaf spring 25 so that a relative movement of the securing element 22 with respect to the leaf spring 25 is possible.

The projections 26 are spaced at a distance from one another whereby the compensating mass 23 having a coordinated cross-piece 28 is supported at the leaf spring 25 such that the cross-piece 28 engages the leaf spring 25 between the projections 26.

With the aid of the FIGS. 2*a–c* the normal movement of the parts of the safety belt buckle without the influence of acceleration or mass forces during the tightening movement of the safety buckle will be described first.

FIG. 2*a* shows the locked state of the safety belt buckle with the inserted insertion tongue Here, the securing element 22 is positioned above the latch 18 (not further represented in this drawing) in a front position within a slotted hole 33 of the side walls 17. At the same time the sliding key 20 is also positioned in its ejected front position in which it is fixed at the housing by its abutments. The sliding key spring 24 as well as the leaf spring 25 generate a force which holds the securing element 22 in its securing position whereby the compensating mass which is arranged between the two spring 24, 25 acts as the transmitting component without itself emitting further forces.

When an opening of the safety belt buckle according to FIG. 2*b* occurs by sliding the sliding key 20 in the direction of the arrow 34, then the sliding key with its legs 21 and the abutments 32 provided thereat come into contact with the securing element 22 and moves it toward its rearward releasing position. With this action the sliding key spring 24 is loaded and the compensating mass 23 is slightly moved forward until the forces of the spring 24 and 25 are compensated. Due to the movement of the securing element 22 into its releasing position a loading of the leaf spring 25 takes place. Again, the compensating mass 23 does not provide any additional forces.

FIG. 2*c* shows the released state of the safety belt buckle 10 in which the sliding key 20 is again positioned in its front position in which it is held by its abutments facing the housing. The sliding key spring 24 is unstressed while the leaf spring 25 is still loaded because the released safety belt buckle with its ejected insertion tongue holds the securing element 22 in its released position so that when the insertion tongue is again inserted the latch 18 may first engage and then the securing element 22 may resume its securing position.

With the aid of FIGS. 3*a* and 3*b* the function of the anti-shock device will be described in the following. In FIG. 3*a* the state of the safety belt buckle 10 is presented in which the safety belt buckle is moved in the direction of the arrow 29 is when subjected to a tightening of the respective safety belt, respectively, of the anchoring portion 12. During this tightening movement an acceleration force acts in the direction of the arrow 30 whereby the safety belt buckle is assurred to be in a position according to the representation of FIG. 2*a*. In this position no relative movement of the safety belt buckle, respectively, of the sliding key 20, compensating mass 23 and securing element 22 relative to one another takes place because all components within the safety belt buckle housing are form-locked.

FIG. 3*b* shows the state of the belt buckle at the end of the tightening process in which the safety belt buckle is abruptly slowed down so that the sliding key 20 tries to perform an insertion movement into the safety belt buckle in the direction of the arrow 34 in FIG. 2*b* which corresponds to a release movement of the safety belt buckle. During this movement the sliding key 20 is moved into the safety belt buckle and generates stress at the sliding key spring 24 while at the same time a movement of the compensating mass 23 in the direction of the sliding key movement takes place which results, due to the support of the compensating mass 23 via the crosspiece 28 at the leaf spring 25, in an additional loading of the leaf spring 25. Since the leaf spring with its stress loads the securing element 22 in its securing position for the latch 18, the increase of the leaf spring stress results in an increase of the force which is holding the securing element 22 in its securing position so that despite the insertion movement of the sliding key 20 under contacting the securing element 22 with its abutments 32, the securing element 22 is held in its securing position for the latch. Accordingly, the securing element 22 provides a holding action for the insertion movement of the sliding key 20.

It is understood that the selection of the size of the compensating mass 23 as well as of the spring forces of the springs 24 and 25 must be individually determined such that the aforementioned equilibrium will be achieved under impact This will then result in an impact protection of the aforementioned safety belt buckle.

Figure 4A:
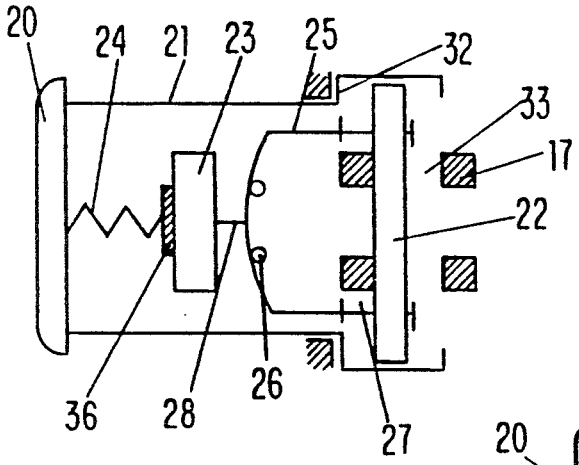
Figure 4B:
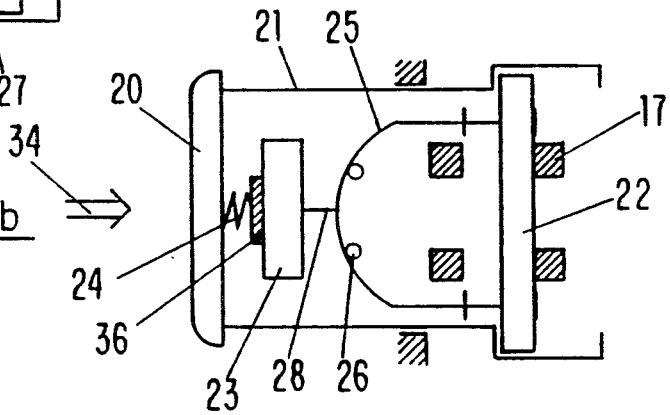
Figure 4C:
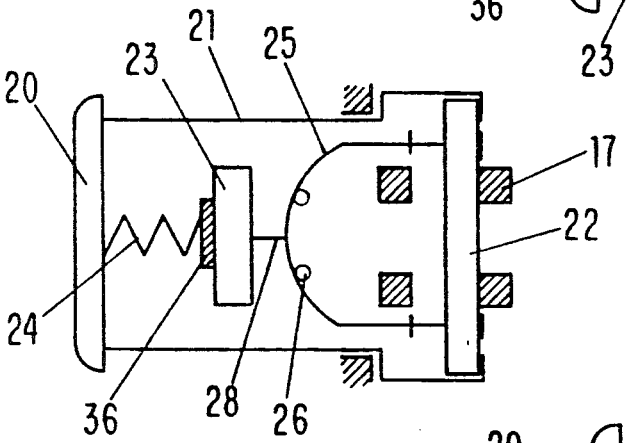
Figure 5A:
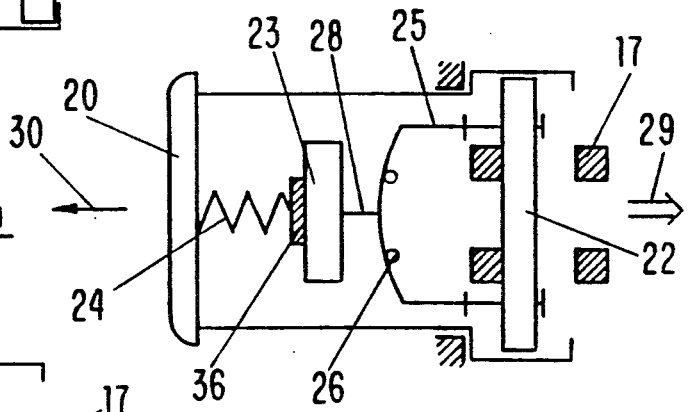
FIG. 5*a, b* the safety belt buckle in a representation according to FIGS. 4*a–c* when acceleration forces occur.
Figure 5B:
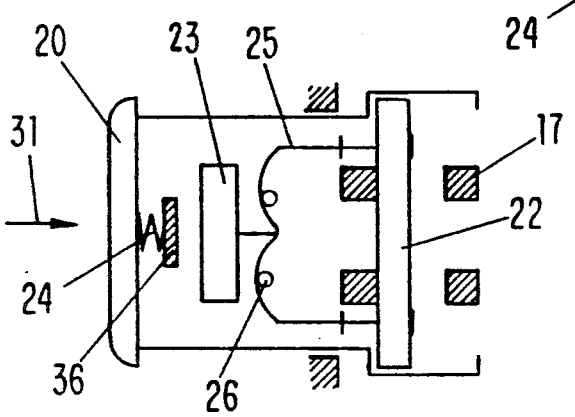

FIGS. 4*a* to 4*c* as well as 5*a* and 5*b* represent another embodiment of the present invention in correspondence to the description of the embodiments of FIGS. 2 and 3. Here, the sliding key spring 24 is not supported at the compensation mass 23 but at an abutment 36 which is fixedly connected to the housing. This abutment 36 serves simultaneously as a support for the compensating mass 23 which is forced by the prestressed leaf spring 25 against the abutment 36. During the course of the movements the rearward movement of the compensating mass 23 is compensated by the abutment 36 when moved from the position shown in FIG. 5*b* into the position of FIG. 5*a*.

Furthermore, identical parts in the FIGS. 4 and 5 are designated by the same reference numerals used in FIGS. 2 and 3. With respect to the function there are no differences between the embodiments so that reference is made accordingly to the detailed description of the FIGS. 2*a* to 2*c* as well as 3*a*, 3*b*, with the difference that the respective support of the sliding key spring 24 as well as the compensating mass 23 via the action of the spring 25 is here achieved at the projection 36 fixedly connected to the housing.

The features of the subject matter of the present papers disclosed in the above description, the claims, the abstract and the drawings may be taken individually or in any desired combination for the realization of the present invention in its various embodiments.

The present invention is, of course, in no way restricted to the specific disclosure of the specification and drawings, but also encompasses any modifications within the scope of the appended claims.

I claim:

1. A safety belt buckle for receiving and locking an insertion tongue that has a cutout, comprising:

a housing having an insertion slot for said insertion tongue;

a spring-loaded ejector for said insertion tongue provided in said insertion slot;

a latch supported within said housing and cooperating with said cutout of said insertion tongue in a locking position of said safety belt buckle, said latch fastening said insertion tongue by engaging a respective recess provided at said housing;

a sliding key, which is loaded by a spring and is slidable in a direction that is transverse to a plane of movement of said latch, for releasing said latch from said locking position;

a securing element, that is slidably disposed within said housing, for fixing and securing said latch in said locking position of said safety belt buckle, said securing element, for releasing said locking position of said safety belt buckle, being slidable by said sliding key into a releasing position of said latch; and a compensating mass that is positioned between said sliding key and said securing element, and compensating mass being supported at a further spring that loads said securing element in a securing position thereof.

2. A safety belt buckle according to claim 1, wherein said further spring is in the form of a leaf spring and said securing element is in the form of a rod, said leaf spring with ends thereof being connected to ends of said rod and being prestressed at a portion thereof facing said sliding key at abutment means of said housing.

3. A safety belt buckle according to claim 2, wherein said abutment means is in the form of two spaced apart projections that are arranged transverse to a longitudinal direction of said safety belt buckle, with said compensating mass having a cross-piece connected thereto, said cross-piece engaging said further spring between said two projections for supporting said compensating mass at said further spring.

4. A safety belt buckle according to claim 2 wherein said ends of said leaf spring are provided with respective slotted holes into which said ends of said rod are inserted.

5. A safety belt buckle according to claim 1, wherein said sliding key, said compensating mass and said securing element are arranged in a same plane of said safety belt buckle that is parallel to an insertion plane of said insertion tongue.

6. A safety belt buckle according to claim 1, wherein said sliding key, said compensating mass and said securing element are arranged in different planes of said safety belt buckles relative to an insertion plane of said insertion tongue.

7. A safety belt buckle according to claim 1, wherein said spring of said sliding key is directly supported at said compensating mass.

8. A safety belt buckle according to claim 1, wherein said housing has an abutment for supporting said spring of said sliding key and for supporting said compensating mass loaded by said further spring.

* * * * *

UNITED STATES PATENT AND TRADEMARK OFFICE

CERTIFICATE OF CORRECTION

PATENT NO. : 5,133,115

DATED : 28 July 1992

INVENTOR(S) : Andreas Bock

It is certified that error appears in the above-identified patent and that said Letters Patent is hereby corrected as shown below:

Title page, item [22] should be --PCT Filed: January 24, 1991--.

Signed and Sealed this

Thirty-first Day of August, 1993

*Attest:*

*Attesting Officer*

BRUCE LEHMAN

*Commissioner of Patents and Trademarks*